US009002252B2

(12) United States Patent
Uehara et al.

(10) Patent No.: US 9,002,252 B2
(45) Date of Patent: Apr. 7, 2015

(54) IMAGE FORMING APPARATUS

(71) Applicant: KYOCERA Document Solutions Inc., Osaka (JP)

(72) Inventors: Masakazu Uehara, Osaka (JP); Masaaki Maruta, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 66 days.

(21) Appl. No.: 13/875,033

(22) Filed: May 1, 2013

(65) Prior Publication Data

US 2013/0302054 A1 Nov. 14, 2013

(30) Foreign Application Priority Data

May 9, 2012 (JP) ..... 2012-107468

(51) Int. Cl.
*G03G 15/20* (2006.01)

(52) U.S. Cl.
CPC ..... *G03G 15/2064* (2013.01)

(58) Field of Classification Search
CPC ..... G03G 15/2067; G03G 15/2089
USPC ..... 399/330, 331
See application file for complete search history.

(56) References Cited

U.S. PATENT DOCUMENTS 8,385,763 B2 2/2013 Tsukioka
8,478,140 B2 7/2013 Hirata
2008/0310895 A1* 12/2008 Masuda et al. ..... 399/331
2011/0058839 A1 3/2011 Tsukioka
2011/0085808 A1 4/2011 Hirata
2011/0176821 A1 7/2011 Hase
2011/0222874 A1* 9/2011 Yamada ..... 399/33

FOREIGN PATENT DOCUMENTS

JP S64-15779 A 1/1989
JP H11-065350 A 3/1999
JP H11-258948 A 9/1999
JP 2002-296923 A 10/2002
JP 2006-171296 A 6/2006
JP 2007-025571 A 2/2007

(Continued)

OTHER PUBLICATIONS

An Office Action; "Notice of Reason for Rejection," issued by the Japanese Patent Office on Jun. 10, 2014, which corresponds to Japanese Patent Application No. 2012-107468 and is related to U.S. Appl. No. 13/875,033.

(Continued)

*Primary Examiner* — Gregory H Curran
(74) *Attorney, Agent, or Firm* — Studebaker & Brackett PC

(57) ABSTRACT

An image forming apparatus includes a fixing unit and an apparatus main body. The fixing unit includes a first rotating member, a second rotating member and a fixing nip forming mechanism. The first rotating member is heated by a heating source. The second rotating member faces to the first rotating member. The fixing nip forming mechanism makes the second rotating member pressed to the first rotating member and forms a fixing nip between the first rotating member and second rotating member. To the apparatus main body, the fixing unit is attachably/detachably installed. The apparatus main body includes a nip pressure changing mechanism. The nip pressure changing mechanism presses the fixing nip forming mechanism and changes a pressure of the fixing nip.

11 Claims, 13 Drawing Sheets

(56) References Cited

FOREIGN PATENT DOCUMENTS

| | | | |
|---|---|---|---|
| JP | 2009-271177 | A | 11/2009 |
| JP | 2011-053625 | A | 3/2011 |
| JP | 2011-081027 | A | 4/2011 |
| JP | 2011-081222 | A | 4/2011 |
| JP | 2011-145543 | A | 7/2011 |
| JP | 2011-209663 | A | 10/2011 |
| JP | 2011-242518 | A | 12/2011 |
| JP | 2011-248093 | A | 12/2011 |

OTHER PUBLICATIONS

An Office Action; "Notice of Reason for Rejection," issued by the Japanese Patent Office on Aug. 12, 2014, which corresponds to Japanese Patent Application No. 2012-107468 and is related to U.S. Appl. No. 13/875,033.

* cited by examiner

IMAGE FORMING APPARATUS

INCORPORATION BY REFERENCE

This application is based on and claims the benefit of priority from Japanese Patent application No. 2012-107468 filed on May 9, 2012, the entire contents of which are incorporated herein by reference.

BACKGROUND

The present disclosure relates to an image forming apparatus comprising a fixing unit configured to fix a toner image on a sheet.

An electrographic image forming apparatus, such as a copying machine or a printer, comprises a fixing device configured to fix a toner image on a sheet . In the fixing device, a heat fixing manner is generally applied to fix the toner image on the sheet by fusing a toner (a developer) with the heat. Such a fixing device with the heat fixing manner includes a first rotating member (for example, a roller or a belt) heated by a heating source and a second rotating member (for example, a roller) pressing the first rotating member to form a fixing nip between the first and second rotating members. Then, by passing the sheet through the fixing nip, the toner image is fixed on the sheet.

As the above-mentioned fixing device, a fixing unit configured to be attachable and detachable to an apparatus main body of the image forming apparatus may be applied. The fixing unit is designed in consideration of convenience of maintenance and part replacement.

On the other hand, in the above-mentioned fixing nip, the toner image may be fixed to various sheets with different thickness and dimensions. For instance, in a case where the toner image is fixed on a nonstandard sheet, such as an envelope or a thin paper, when a pressure (hereinafter, called as a "nip pressure") of the fixing nip is the same as that of another case where the toner image is fixed on a standard sheet, there is fear that the sheet is crinkled. In recent years, particularly, the image forming apparatus is expected to correspond to speeding up and colorization, but it is difficult that one nip pressure satisfies conveying performance and fixing performance to various types of the sheets.

By contrast, a fixing unit varying a nip pressure in accordance with a sheet type is developed. For example, the fixing unit includes a pressing lever for holding a pressing roller, a compression spring for making the pressing roller pressed to a heating roller, and a cam for moving the pressing roller in a direction of increasing a shaft center distance between the pressing and heating rollers.

In this fixing unit, a gear is attached to a shaft connected with the cam, the gear is meshed with another gear of the apparatus main body, and moreover, a driving force from a driver installed to the apparatus main body is transmitted to the shaft via the above-mentioned gears so as to rotate the cam together with the shaft. As a nip pressure changing manner, except for a manner using the cam, other manners sliding a lever or operating a button are known.

In technique as mentioned above, because the fixing unit is provided with a nip pressure changing mechanism including the cam and shaft, the increasing size and complication of the fixing unit are incurred. In addition, on the structure locating the nip pressure changing mechanism in the fixing unit, because it is necessary to bear great load caused in changing the nip pressure by the fixing unit, there is fear that excessive load is applied to the fixing unit.

Further, the above-mentioned technique has a structure transmitting the driving force from the apparatus main body to the shaft via the apparatus main body side gear and fixing unit side gear. Therefore, there are fears that tooth jumping of each gear is caused and malfunction is caused by excessive shaft torque applied to each gear.

SUMMARY

In accordance with an embodiment of the present disclosure, an image forming apparatus includes a fixing unit and an apparatus main body. The fixing unit includes a first rotating member, a second rotating member and a fixing nip forming mechanism. The first rotating member is heated by a heating source. The second rotating member faces to the first rotating member. The fixing nip forming mechanism makes the second rotating member pressed to the first rotating member and forms a fixing nip between the first rotating member and second rotating member. To the apparatus main body, the fixing unit is attachably/detachably installed. The apparatus main body includes a nip pressure changing mechanism. The nip pressure changing mechanism presses the fixing nip forming mechanism and changes a pressure of the fixing nip.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First Embodiment

Figure 1:
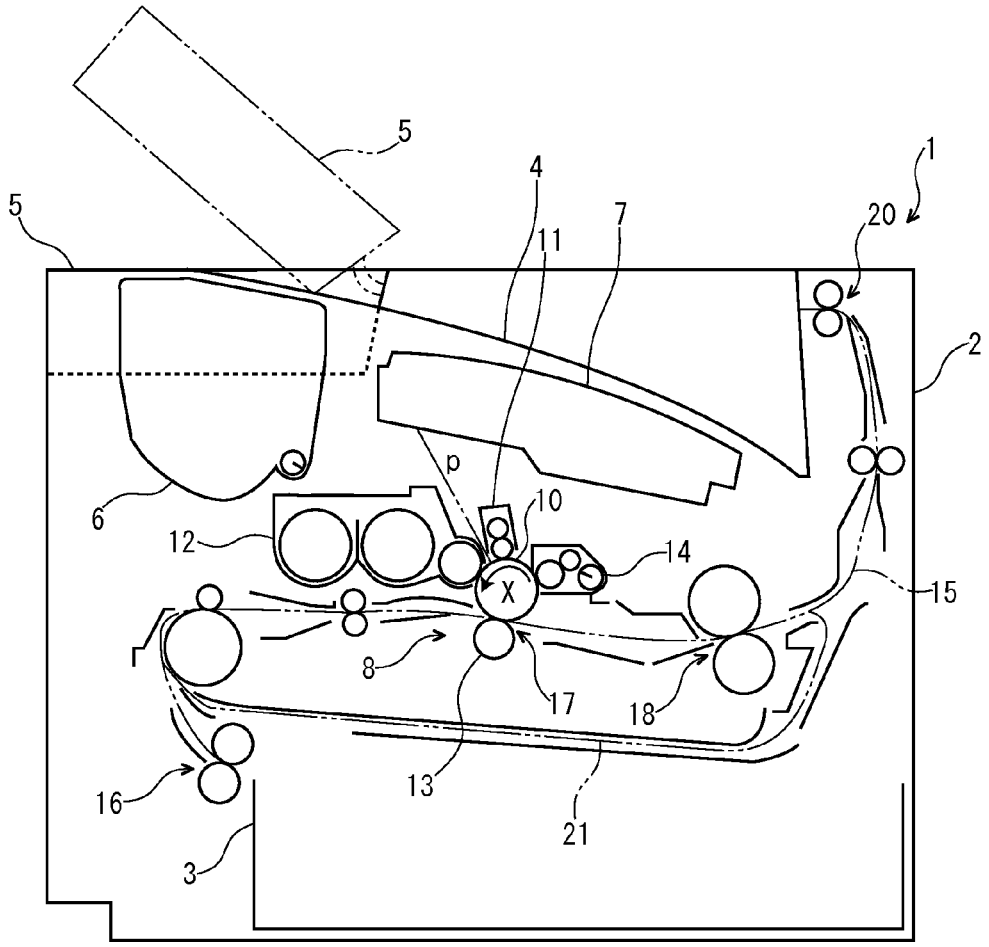
FIG. 1 is a schematic diagram schematically showing a printer according to a first embodiment of the present disclosure.

With reference to FIG. 1, the entire structure of a printer 1 as an image forming apparatus will be described. FIG. 1 is a schematic diagram schematically showing the printer according to a first embodiment of the present disclosure. Hereinafter, it will be described so that the front side of the printer 1 is positioned at the left-hand side of FIG. 1.

The printer 1 includes a box-formed printer main body (an apparatus main body) 2. In a lower part of the printer main body 2, a sheet feeding cartridge 3 configured to store sheets (not shown) is installed and, on the top surface of the printer main body 2, a sheet ejecting tray 4 is mounted. On the top surface of the printer main body 2, an upper cover 5 is openably/closably attached in front of the sheet ejecting tray 4 and, below the upper cover 5, a toner container 6 is installed.

In an upper part of the printer main body 2, an exposure device 7 composed of a laser scanning unit (LSU) is installed below the sheet ejecting tray 4. Below the exposure device 7, an image forming unit 8 is installed. In the image forming unit 8, a photosensitive drum 10 as an image carrier is rotatably installed. Around the photosensitive drum 10, a charger 11, a development device 12, a transfer roller 13 and a cleaning device 14 are located along a rotating direction (refer to arrow X in FIG. 1) of the photosensitive drum 10.

Inside the printer main body 2, a sheet conveying path 15 is arranged. At an upper stream end of the conveying path 15, a sheet feeder 16 is positioned. At an intermediate stream part of the conveying path 15, a transferring unit 17 constructed of the photosensitive drum 10 and transfer roller 13 is positioned. At a lower stream part of the conveying path 15, a fixing unit 18 is positioned. At a lower stream end of the conveying path 15, a sheet ejecting unit 20 is positioned. Below the conveying path 15, an inversion path 21 for duplex printing is arranged.

Next, the operation of forming an image by the printer 1 having such a configuration will be described.

When the power is supplied to the printer 1, various parameters are initialized and initial determination, such as temperature determination of the fixing unit 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data on the photosensitive drum 10 is carried out by a laser (refer to two-dot chain line P in FIG. 1) from the exposure device 7, thereby forming an electrostatic latent image on the surface of the photosensitive drum 10. Subsequently, the electrostatic latent image is developed to a toner image with a toner (a developer) in the development device 12.

On the other hand, a sheet fed from the sheet feeding cartridge 3 by the sheet feeder 16 is conveyed to the transferring unit 17 in a suitable timing for the above-mentioned image forming operation, and then, the toner image on the photosensitive drum 10 is transferred onto the sheet in the transferring unit 17. The sheet with the transferred toner image is conveyed to a lower stream on the conveying path 15 to go forward to the fixing unit 18, and then, the toner image is fixed on the sheet in the fixing unit 18. The sheet with the fixed toner image is ejected from the sheet ejecting unit 20 to the sheet ejecting tray 4. Toner remained on the photosensitive drum 10 is collected by the cleaning device 14.

Figure 2:
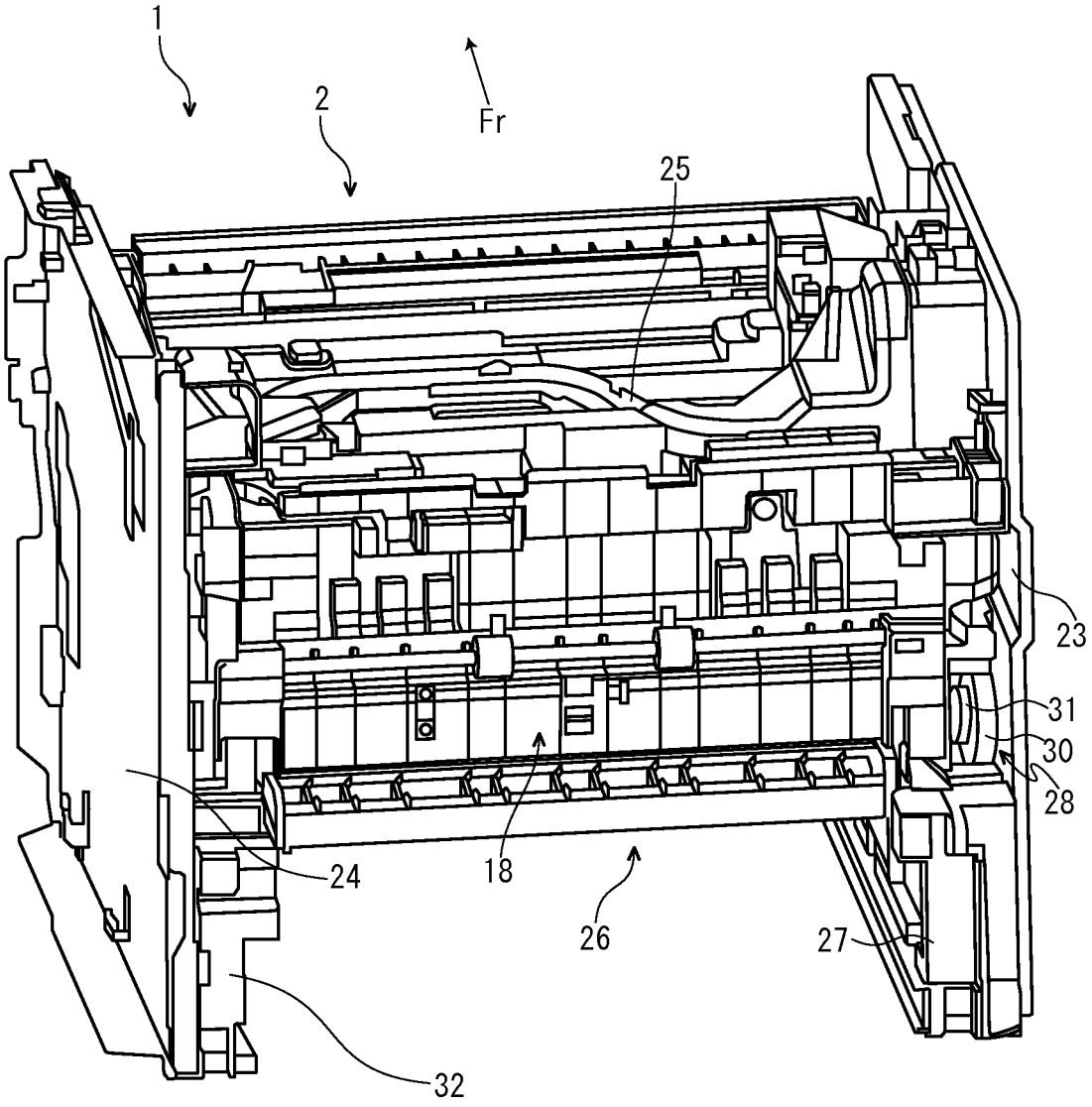
FIG. 2 is a back perspective view showing a printer main body in a situation of installing a fixing unit in the printer according to the first embodiment of the present disclosure.
Figure 3:
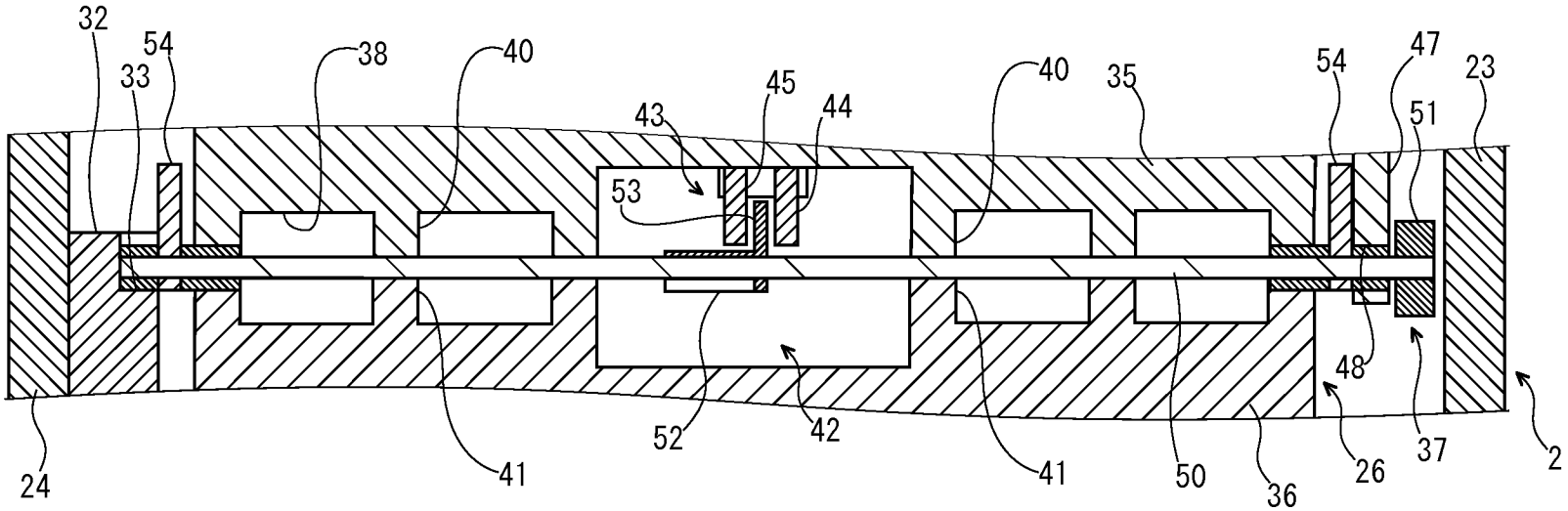
FIG. 3 is a back sectional view showing the printer main body of the printer according to the first embodiment of the present disclosure.
Figure 4:
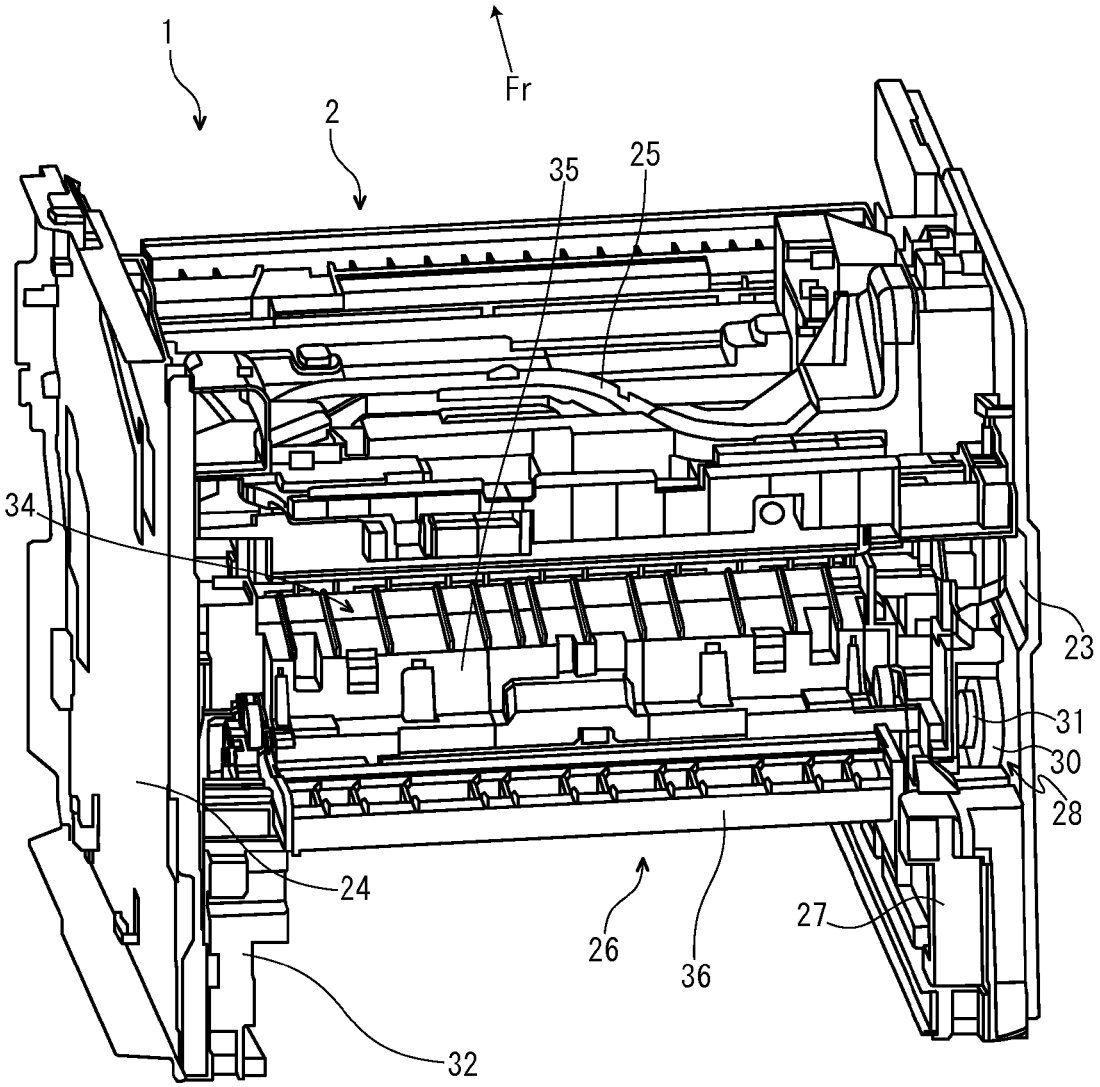
FIG. 4 is a back perspective view showing the printer main body in a situation of detaching the fixing unit in the printer according to the first embodiment of the present disclosure.
Figure 5:
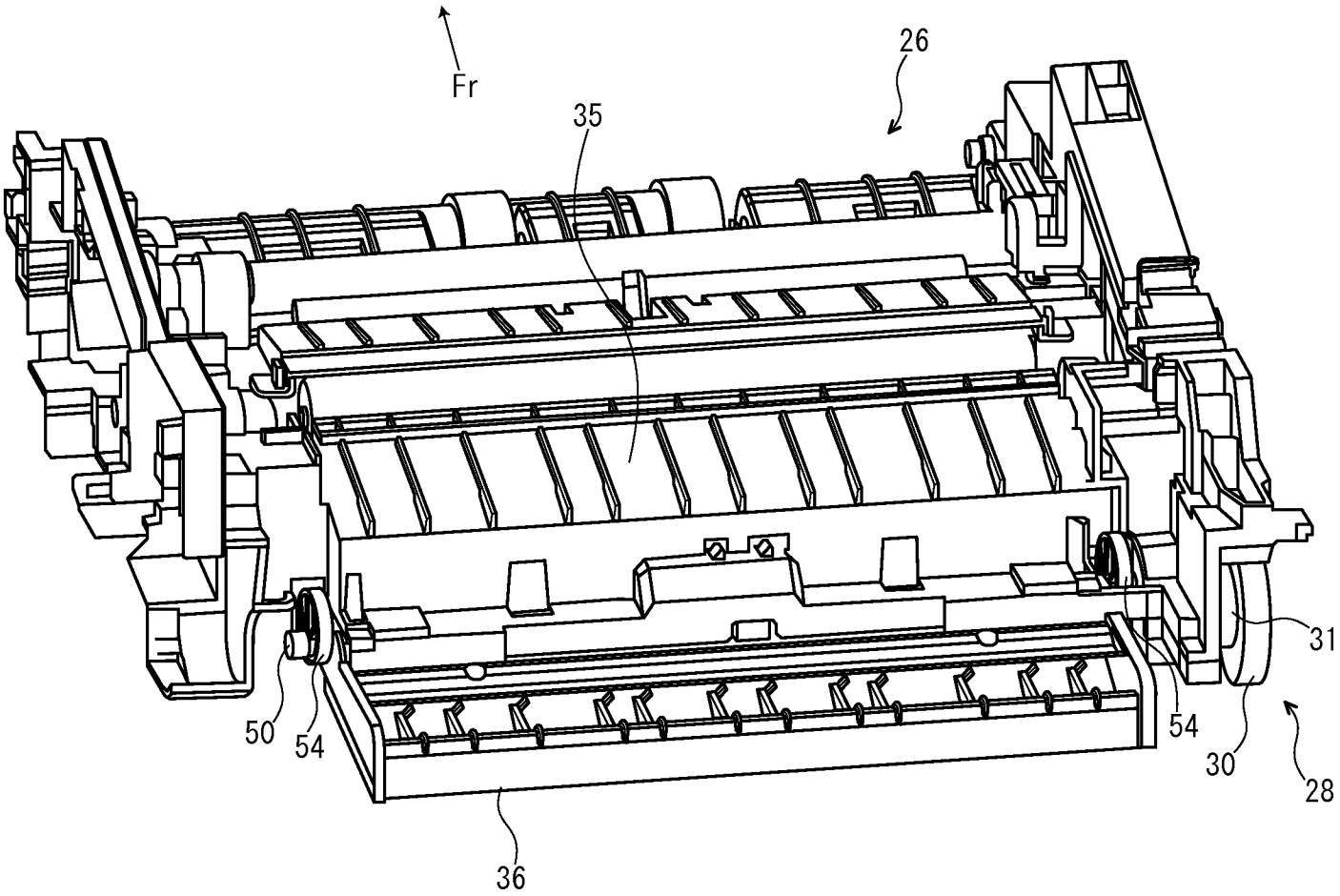
FIG. 5 is a back perspective view showing a conveying unit in the printer according to the first embodiment of the present disclosure.
Figure 6:
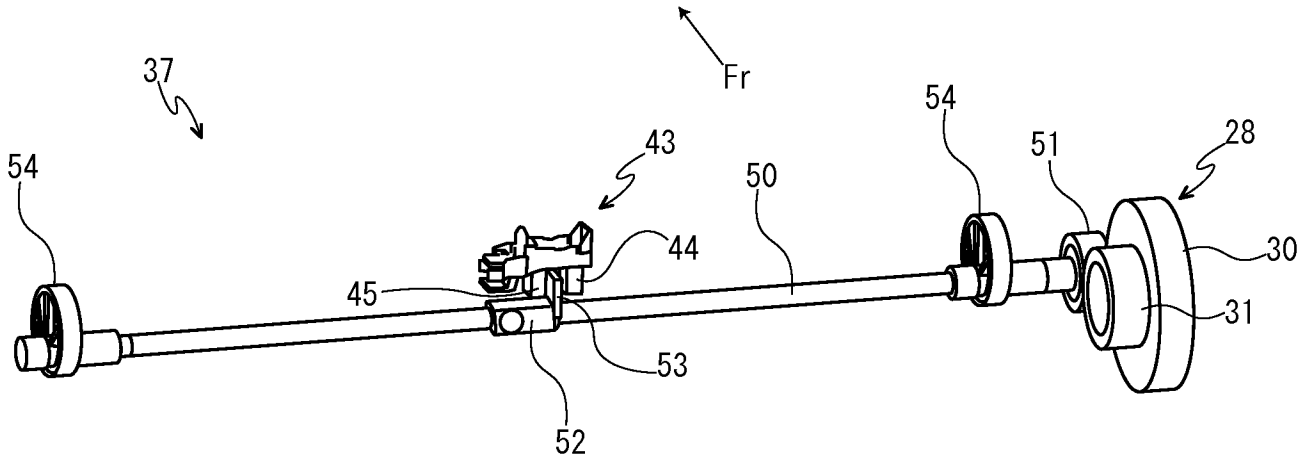
FIG. 6 is a back perspective view showing a connecting gear and a nip pressure changing mechanism in the printer according to the first embodiment of the present disclosure.
Figure 7:
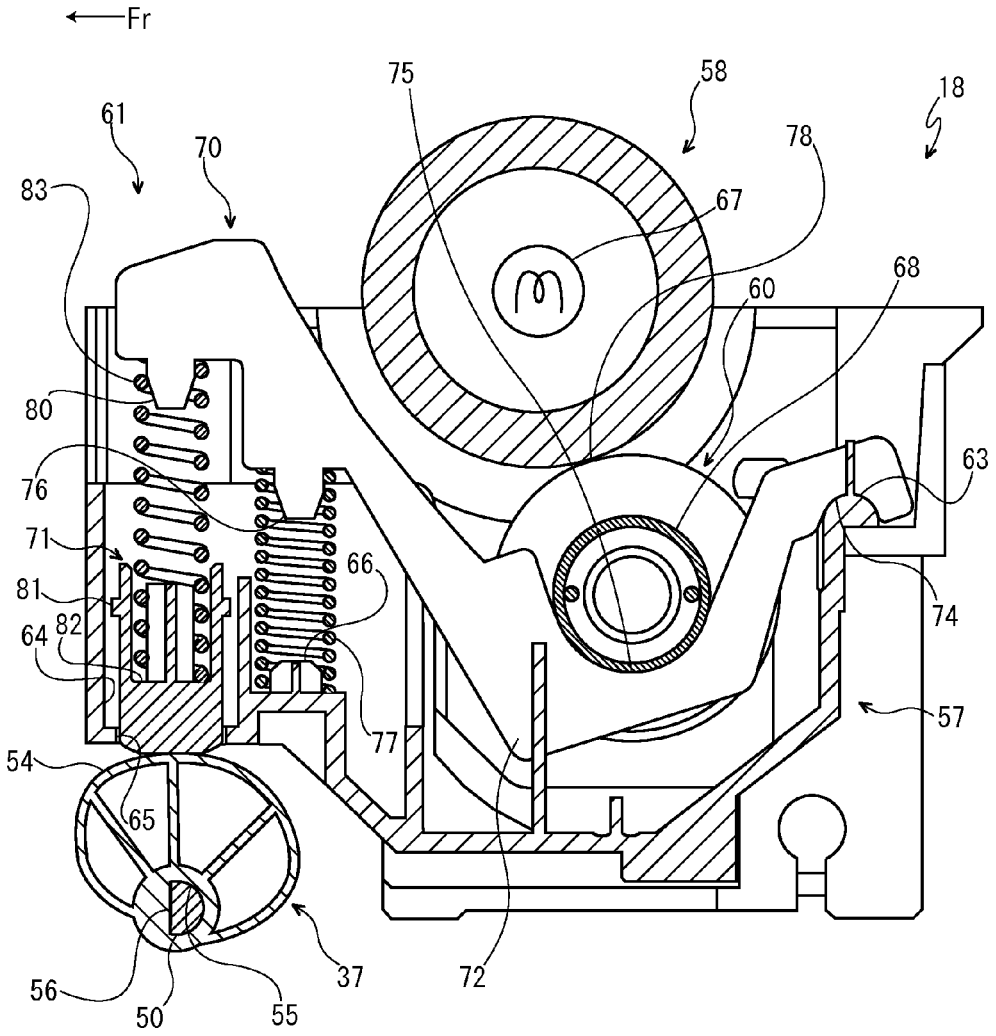
FIG. 7 is a right side sectional view showing the printer in a situation, in which a cam presses a spring holder, according to the first embodiment of the present disclosure.
Figure 8:
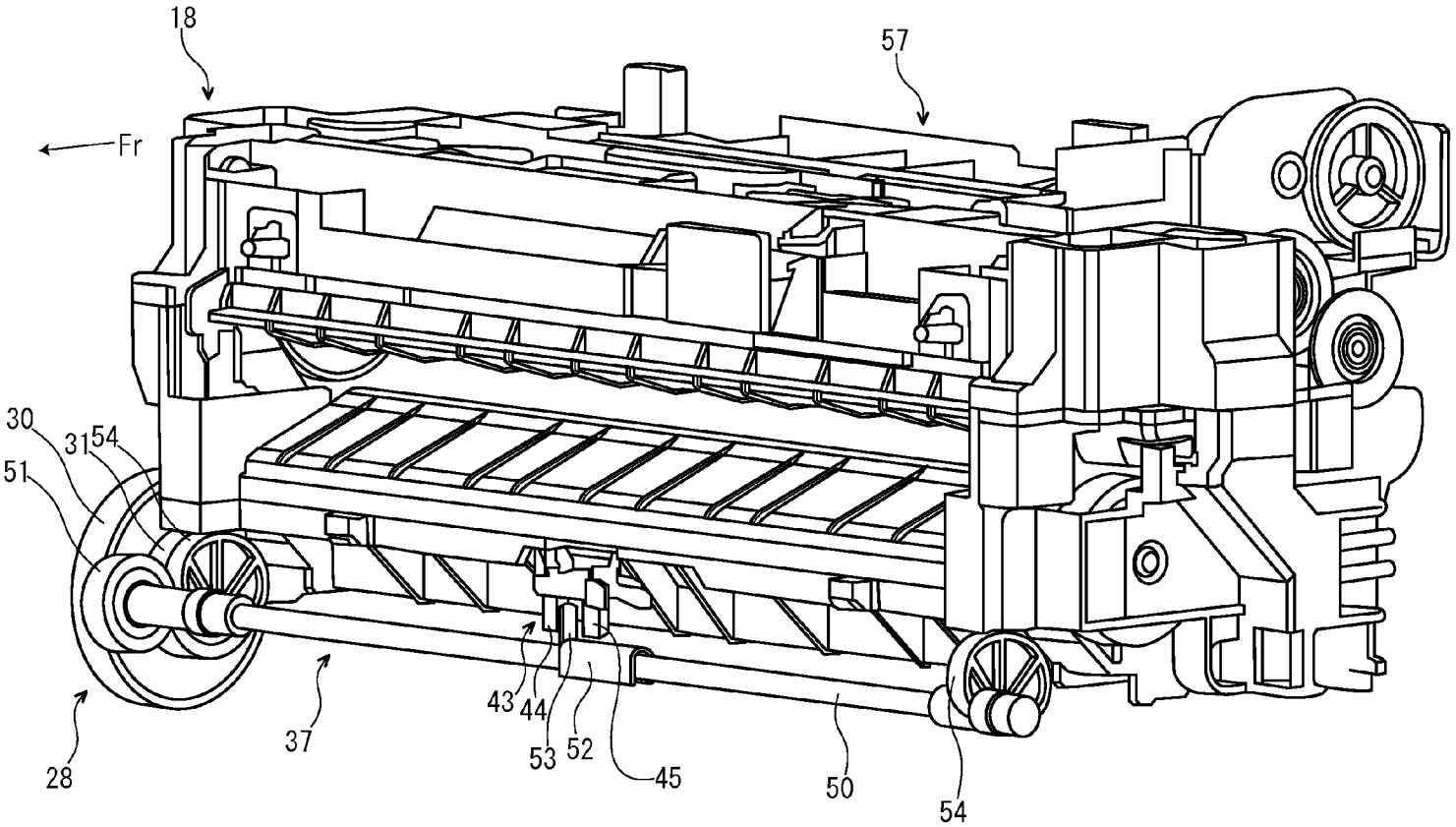
FIG. 8 is a right front perspective view showing the printer in a situation, in which the cam presses the spring holder, according to the first embodiment of the present disclosure.

Next, with reference to FIGS. 2-8, the printer main body 2 and fixing unit 18 will be described in detail. FIG. 2 is a back perspective view showing the printer main body in a situation of installing the fixing unit in the printer according to the first embodiment of the present disclosure. FIG. 3 is a back sectional view showing the printer main body of the printer according to the first embodiment of the present disclosure. FIG. 4 is a back perspective view showing the printer main body in a situation of detaching the fixing unit in the printer according to the first embodiment of the present disclosure. FIG. 5 is a back perspective view showing a conveying unit in the printer according to the first embodiment of the present disclosure. FIG. 6 is a back perspective view showing a connecting gear and a nip pressure changing mechanism in the printer according to the first embodiment of the present disclosure. FIG. 7 is a right side sectional view showing the printer in a situation, in which a cam presses a spring holder, according to the first embodiment of the present disclosure. FIG. 8 is a right front perspective view showing the printer in a situation, in which the cam presses the spring holder, according to the first embodiment of the present disclosure. Arrow Fr suitably put on each figure indicates the front side of the printer 1. Because FIGS. 2-6 are the back views, the left-hand and right-hand sides of the figure are converse to the actual left-hand and right-hand sides.

First, the printer main body 2 will be described. As shown in FIG . 2 and other figure, the printer main body 2 includes left and right main body frames 23 and 24 extending in the upper and lower directions, a center frame 25 bridged between upper parts of the left and right main body frames 23 and 24, and a conveying unit 26 bridged between the left and right main body frames 23 and 24 below the center frame 25.

On a lower backward corner of the left main body frame 23, a left guide cassette 27 is attached. In the left guide cassette 27, a first driving motor (not shown in FIG. 2) as a driving source is installed. The first driving motor is connected with a large diameter part 30 of a connecting gear 28 rotatably supported in the left main body frame 23 or left guide cassette 27. In the connecting gear 28, a small diameter part 31 is attached inward than the large diameter part 30.

As shown in FIG. 3, on a lower backward corner of the right main body frame 24, a right guide cassette 32 is attached. In the right guide cassette 32, a depression-formed shaft supporting part 33 is formed. As shown in FIG. 4, between respective rear parts of the center frame 25 and conveying unit 26, a fixing unit installed part 34 is arranged.

As shown in FIG. 5, the conveying unit 26 is formed in a flat-liked shape lengthened in the left and right directions. As shown in FIG. 3, the conveying unit 26 includes an upper side conveying frame 35 and a lower side conveying frame (a conveying frame for duplex printing) 36 connected with each other, and a nip pressure changing mechanism 37 located between the upper side conveying frame 35 and lower side conveying frame 36.

Between the upper side conveying frame 35 and lower side conveying frame 36, a shaft hole 38 is formed in the left and right directions. In the shaft hole 38, a plurality of upper side ribs 40 are located at predetermined intervals in the left and right directions and protruded from the upper side conveying frame 35 and a plurality of lower side ribs 41 are located at predetermined intervals left and right directions and protruded from the lower side conveying frame 36.

In the center of the shaft hole 38 in the left and right directions, a housing part 42 is arranged, and, in the housing part 42, a sensing mechanism 43 fixed onto the upper side conveying frame 35 is housed. The sensing mechanism 43 is, for example, a photo interrupter (PI) sensor and includes a light emitting part 44 and a light receiving part 45 faced to each other at a predetermined distance. In a left end of the upper side conveying frame 35, a supporting piece 47 is formed, and, in the supporting piece 47, a bearing hole 48 is bored in the left and right directions.

The nip pressure changing mechanism 37 includes a straight rod-formed shaft 50 lengthened in the left and right directions. The shaft 50 is, for instance, made of metal. The shaft 50 is inserted into the shaft hole 38 of the conveying unit 26 so that left and right ends of the shaft 50 are stuck out from the conveying unit 26. The shaft 50 is also attached so as to be interposed between the upper side ribs 40 of the upper side conveying frame 35 and the lower side ribs 41 of the lower side conveying frame 36. The right end of the shaft 50 is pivotally supported by the shaft supporting part 33 arranged on the right guide cassette 32 and the left end of the shaft 50 is pivotally supported in the bearing hole 48 arranged on the supporting piece 47 of the upper side conveying frame 35. Accordingly, the shaft is rotatably supported in the printer main body 2.

As shown in FIG. 6, on the left end of the shaft 50, a driving gear 51 is fixedly attached. The driving gear 51 meshes with the small diameter part 31 of the connecting gear 28 provided in the printer main body 2. In the center of the shaft 50 in the left and right directions, a sensing lever 52 is fixedly attached. Onto the sensing lever 52, a flat plate-formed sensed object 53 extending in the upper and lower directions is attached at a position corresponding to the sensing mechanism 43 of the upper side conveying frame 35.

Onto the right end and a left side part of the shaft 50, ellipse-formed cams 54 are fixedly attached. As shown in FIG. 7, in the cams 54, fixing holes 55 with D-shaped cross-section are formed, and then, fixing parts 56 with D-shaped cross-section of the shaft 50 are respectively inserted into the fixing holes 55, thereby restricting relative rotations of the cams 54 on the shaft 50.

Next, the fixing unit 18 will be described. As shown in FIG. 2, the fixing unit 18 is attachably/detachably installed to the fixing unit installed part 34 (refer to FIG. 4) of the printer main body 2.

As shown in FIG. 7, the fixing unit 18 includes a box-formed fixing frame 57, a heating roller 58 as a first rotating member, a pressing roller 60 as a second rotating member and fixing nip forming mechanisms 61. The heating roller 58 and pressing roller 60 are housed in the fixing frame 57 so as to face to each other. The fixing nip forming mechanisms 61 are respectively located onto left and right ends of the heating roller 58 and pressing roller 60.

In left and right ends in a rear end of the fixing frame 57, engaged objects 63 are formed in semicircular arc-liked shapes curved upward. In left and right ends in a front end of the fixing frame 57, holder housings 64 extending in the upper and lower directions are formed, and, in a lower end of each holder housing 64, an inserting hole 65 is bored in the upper and lower directions. In the fixing frame 57, fixing frame side spring receptions 66 are provided behind the respective holder housings 64.

The heating roller 58 is formed in a lengthened shape in the left and right directions. The heating roller 58 includes, for instance, a cylinder-formed core member, an elastic layer provided around the core member and a release layer covering the elastic layer. The core member of the heating roller 58 is, for example, made of metal, such as aluminum or iron. The elastic layer of the heating roller 58 is, for example, made of silicon rubber or the like. The release layer of the heating roller 58 is, for example, made of fluororesin, such as per fluoro alkoxy (PFA). Left and right end of the heating roller 58 are rotatably supported in the fixing frame 57. In internal space of the heating roller 58, a heater 67 as a heating source is housed. The heater 67 is configured by, for example, a halogen heater or ceramic heater.

The pressing roller 60 is formed in a lengthened shape in the left and right directions. The pressing roller 60 includes, for instance, a cylinder-formed core member, an elastic layer provided around the core member and a release layer covering the elastic layer. The core member of the pressing roller 60 is, for example, made of metal, such as aluminum or iron. The elastic layer of the pressing roller 60 is, for example, made of silicon rubber or the like. The release layer of the pressing roller 60 is, for example, made of fluororesin, such as per fluoro alkoxy (PFA). On left and right end of the pressing roller 60, bearings 68 are attached.

The left and right fixing nip forming mechanisms 61 are symmetrically configured to have similar structure to each other. The right (left) fixing nip forming mechanism 61 includes a pressurizing member 70 housed in the left and right ends of the fixing frame 57 and a spring holder 71 located below and in front of the pressurizing member 70.

The pressurizing member 70 is formed by sheet metal and includes a bend part 72 in the center in the forward and backward directions so as to be formed roughly in an L-shape. In a rear end of the pressurizing member 70, a semicircular arc-liked engaging part 74 is formed. The engaging part 74 engages with the engaged object 63 formed in the fixing frame 57, thereby supporting the pressurizing member 70, in a rotatable state around a side of the engaging part 74 (a rear side in the first embodiment), onto the fixing frame 57. In a rear part of the pressurizing member 70, a holding part 75 is formed, and, on the right (left) holding part 75, the right end (left end) of the pressing roller 60 is rotatably held via the respective bearing 68.

In a front part of the pressurizing member 70, a first spring reception 76 is formed. The first spring reception 76 is located on the opposite side of the engaging part 74 across the holding part 75. Between the first spring reception 76 and fixing frame side spring receptions 66 of the fixing frame 57, a first spring 77 configured by a coil spring is installed. The first spring 77 biases the pressurizing member 70 upward, and accordingly, the pressurizing member 70 adds pressure to the pressing roller 60 in the direction toward the heating roller 58. Thereby, the pressing roller 60 is pressed to the heating roller 58 to form a fixing nip 78 between the heating roller 58 and pressing roller 60. Then, the fixing unit 18 is configured so that, when the sheet passes through the fixing nip 78, the toner image is fixed on the sheet. In a front end of the pressurizing member 70, a second spring reception 80 is formed. The second spring reception 80 is located on the opposite side of the engaging part 74 across the holding part 75 and located at a position further away from the engaging part 74 than the first spring reception 76.

The spring holder 71 is installed in an upward/downward movable state in the holder housing 64 formed in the fixing frame 57. The spring holder 71 is inserted into the inserting hole 65 bored in the holder housing 64. A lower end of the spring holder 71 is located right above the cam 54 provided in the nip pressure changing mechanism 37 of the printer main body 2. On the circumference of an upper part of each spring holder 71, a circular engaging protrusion 81 is formed.

On an upper surface side of each spring holder 71, a holder side spring reception 82 extending in the upper and lower directions is arranged. Between the holder side spring reception 82 and second spring reception 80 of the pressurizing member 70, a second spring 83 configured by a coil spring is installed.

Figure 9:
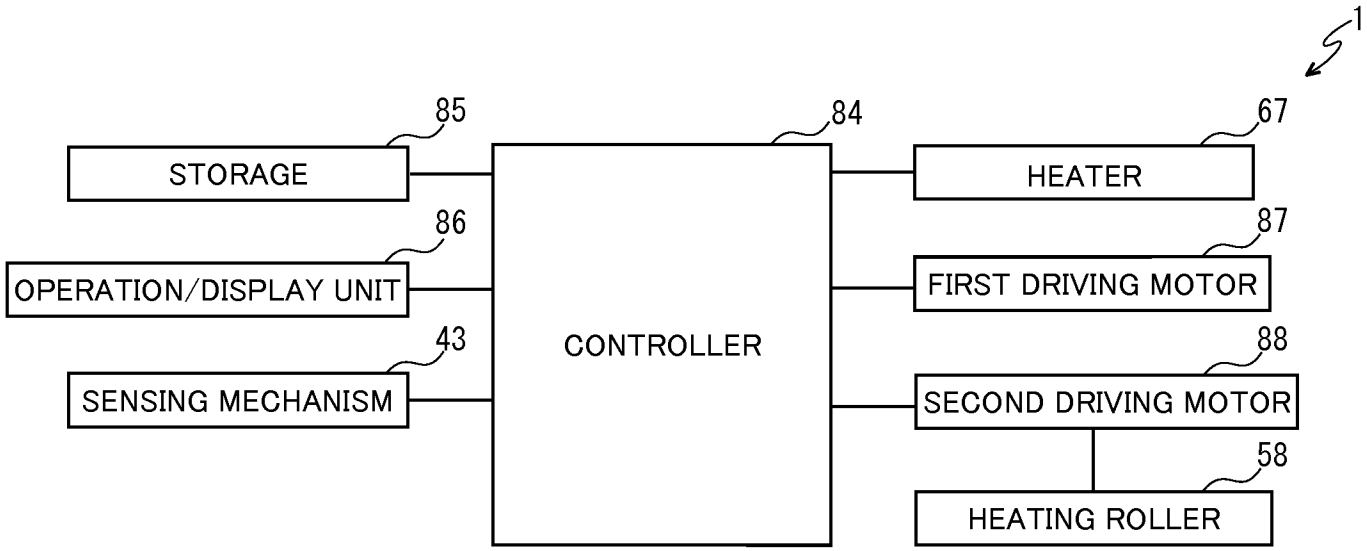
FIG. 9 is a schematic block diagram showing the printer according to the first embodiment of the present disclosure.

Next, mainly with reference to FIG. 9, a controlling system of the printer 1 will be described. FIG. 9 is a schematic block diagram showing the printer according to the first embodiment of the present disclosure.

The printer 1 is provided with a controller (CPU: Central Processing Unit) 84. The controller 84 is connected with a storage 85 configured by a storing device, such as ROM (Read Only Memory) or RAM (Random Access Memory). The controlling system is then configured so that the controller 84 controls components of the printer 1 on the basis of control programs and control data stored in the storage 85. The controller 84 is also configured to control a conveyance speed of the sheet to the fixing nip 78.

The controller 84 is connected with an operation/display unit 86 arranged on the printer main body 2. The operation/display unit 86 is provided with operation keys, such as a start key, a stop/clear key, a power key, numeric keys and a touch panel, and then, the controlling system is configured so that, when a user handles the operation keys, an instruction according to the handling is outputted to the controller 84.

The controller 84 is connected with the sensing mechanism 43, and then, the controlling system is configured so that, when the sensing mechanism 43 senses a position of the sensed object 53 attached on the sensing lever 52 of the nip pressure changing mechanism 37, a sensing signal from the sensing mechanism 43 is outputted to the controller 84.

The controller 84 is connected with a heater 67, and then, the controlling system is configured so that the heater 67 is electrified on the basis of a signal from the controller 84 to heat the heating roller 58.

The controller 84 is connected with the first driving motor 87 installed in the left guide cassette 27 as mentioned above, and then, the controlling system is configured so that the first driving motor 87 rotates on the basis of a drive instructing signal from the controller 84. The controller 84 is connected with the heating roller 58 via a second driving motor 88, and then, the controlling system is configured so that the second driving motor 88 make the heating roller 58 rotated on the basis of a drive instructing signal from the controller 84.

A nip pressure changing operation in the above-mentioned configuration is described below.

Figure 10:
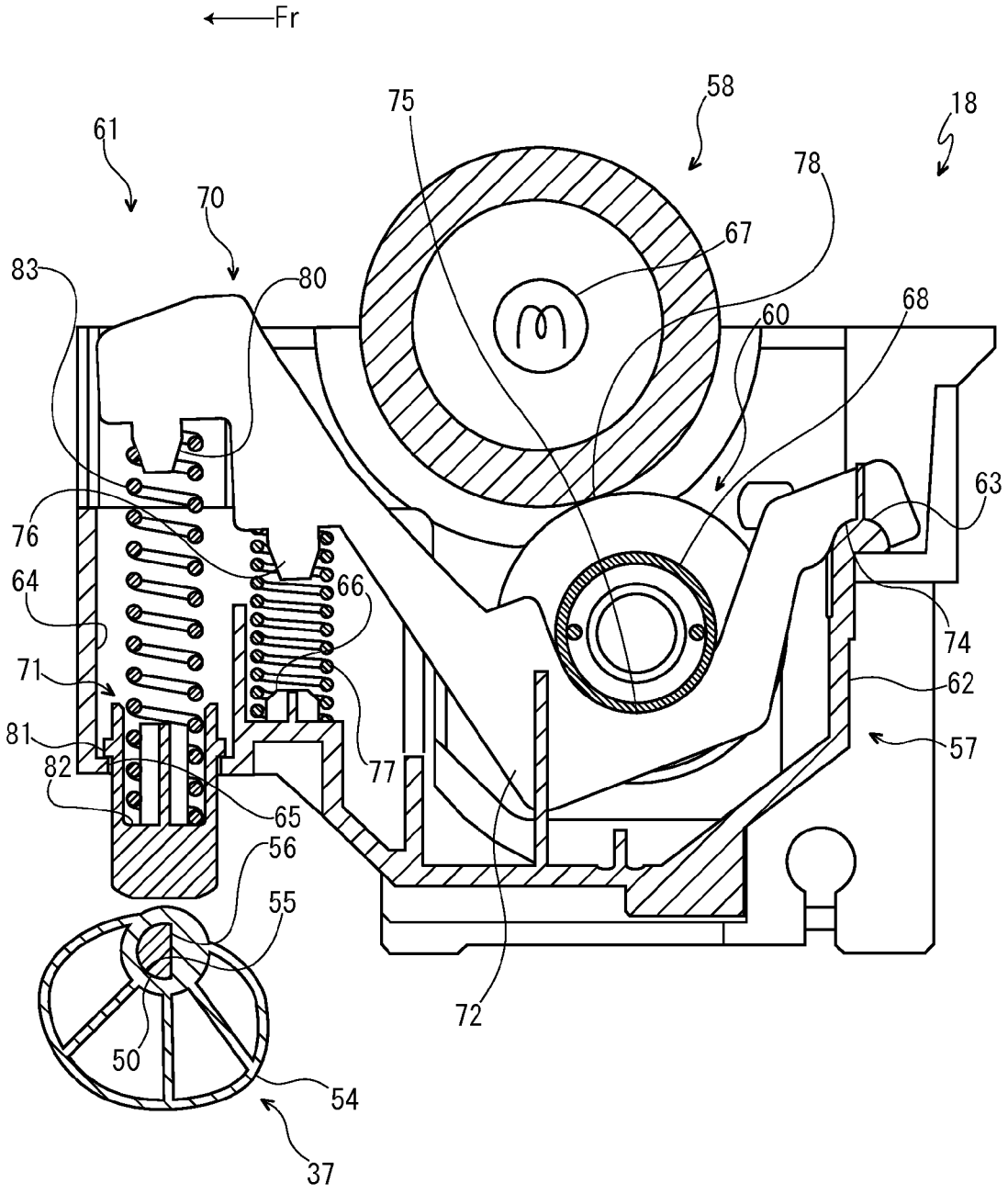
FIG. 10 is aright side sectional view showing the printer in a situation, in which the pressure of the cam on the spring holder is released, according to the first embodiment of the present disclosure.
Figure 11:
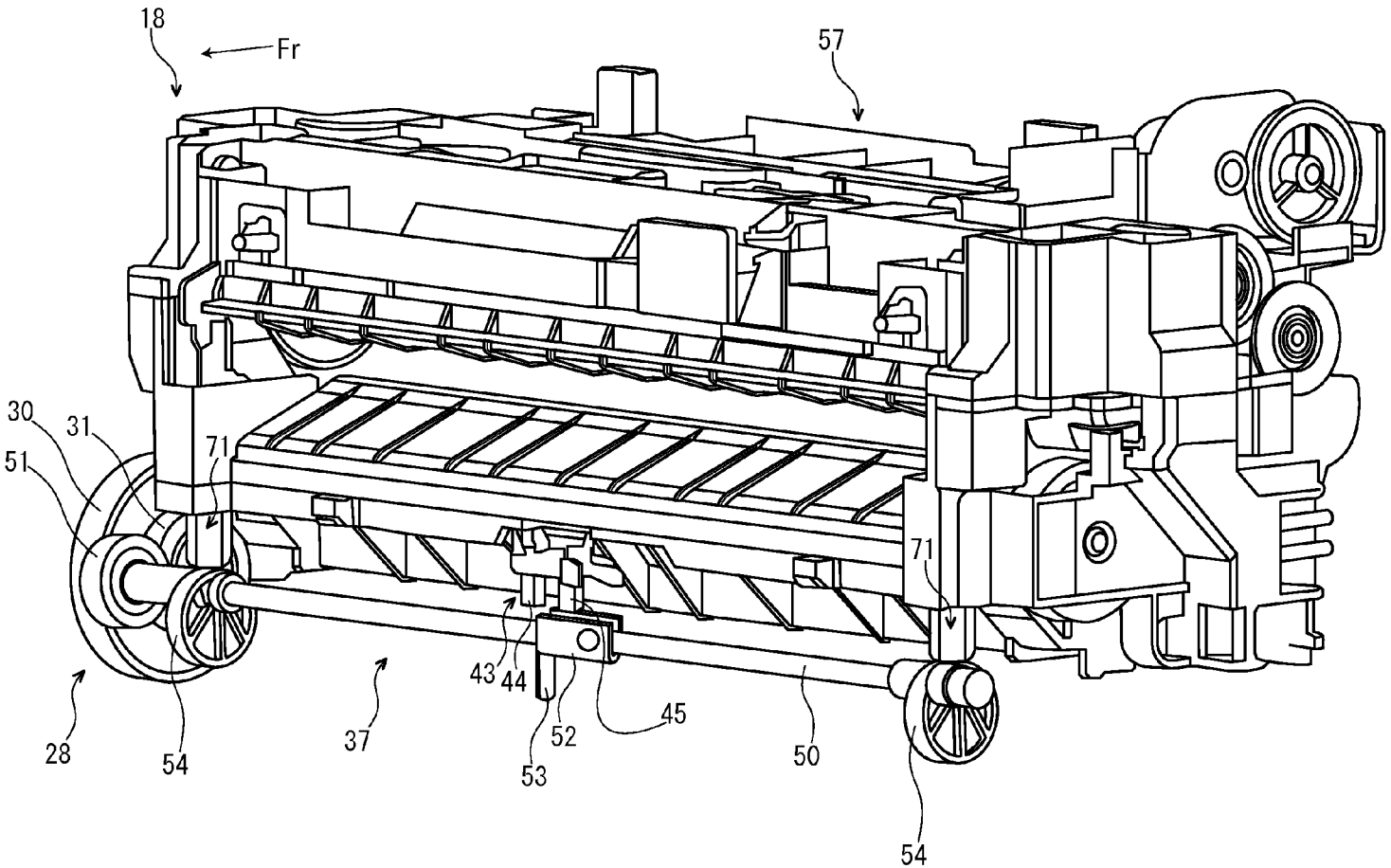
FIG. 11 is a right front perspective view showing the printer in a situation, in which the pressure of the cam on the spring holder is released, according to the first embodiment of the present disclosure.

Before the power is supplied to the printer 1, as shown in FIGS. 10 and 11, the cam 54 faces to the lower end of the spring holder 71 at a slight distance, that is, the cam 54 does not press the spring holder 71. A distance from the lower end of the holder side spring reception 82 of the spring holder 71 to the second spring reception 80 is longer than a natural length of the second spring 83. Therefore, a biasing force of the second spring 83 does not work on the pressurizing member 70, while a biasing force of the first spring 77 works so that the pressurizing member 70 adds pressure in the direction toward the heating roller 58 to the pressing roller 60 . The nip pressure at this moment is indicated as P1 (a first nip pressure P1).

In such a situation, when the power is supplied to the printer 1 by operating the power key of the operation/display unit 86, the first driving motor 87 rotates on the basis of the drive instructing signal from the controller 84. This rotation is transmitted to the shaft 50 via the connecting gear 28 and driving gear 51, and then, the nip pressure changing mechanism 37 turns 180 degrees in one direction. In accordance with this turn, the cam 54 of the nip pressure changing mechanism 37 presses the lower end of the spring holder 71 upward.

By this pressing, as shown in FIG. 7, the spring holder 71 moves in the direction (an upward direction in the first embodiment) approaching to the second spring reception 80, and then, the spring holder 71 presses the second spring reception via the second spring 83 upward. Accordingly, the pressurizing member 70 turns around the side of the engaging part 74 upward, the pressing roller 60 approaches to the heating roller 58, and the pressing roller 60 stops at a position where a pressing force from the pressurizing member 70 to the pressing roller 60 is balanced with a repulsive force of the elastic layer of the pressing roller 60. Consequently, the nip pressure shifts to a pressure P2 (a second nip pressure P2) greater than the pressure P1. Thus, the nip pressure changing mechanism 37 is configured to change the pressure of the fixing nip 78 between the pressures P1 and P2. At this moment, the biasing force of the first spring 77 works on the pressurizing member 70.

As mentioned above, when the nip pressure changing mechanism 37 turns 180 degrees, as shown in FIG. 8, the sensed object 53 attached on the sensing lever 52 of the nip pressure changing mechanism 37 is inserted between the light emitting part 44 and light receiving part 45 of the sensing mechanism 43 of the printer main body 2. Thereby, the sensing mechanism 43 senses the turn of the nip pressure changing mechanism 37, and then, outputs the sensing signal to the controller 84.

In a situation of this nip pressure P2, the toner image is fixed on a sheet, such as a plain paper. At this moment, the conveyance of the sheet to the fixing nip 78 is controlled at a normal speed by the controller 84.

On the other hand, if a fixing of the toner image on another sheet, such as an envelope or a thin paper, is carried out by the above-mentioned nip pressure P2, because the nip pressure is too strong, there is fear of crinkling the other sheet and lowering conveyance performance. Therefore, for the other sheet, the operation/display unit 86 is operated so that the nip pressure is reduced lower than the normal pressure. In this operation, for example, the envelope or thin paper is selected as a sheet type. When an instruction of such a selection is outputted from the operation/display unit 86 to the controller 84, the controller 84 sends the drive instructing signal to the first driving motor 87. According to the drive instructing signal, the first driving motor 87 rotates, this rotation is transmitted to the shaft 50 via the connecting gear 28 and driving gear 51, and then, the nip pressure changing mechanism 37 turns 180 degrees in the one direction or a reverse direction.

Accordingly, as shown in FIG. 10, the pressing of the cam 54 of the nip pressure changing mechanism 37 to the spring holder 71 is released. Consequently, the spring holder 71 goes down by self-weight, and then, the engaging protrusion 81 of the spring holder 71 comes into contact with the holder housing 64 around the inserting hole 65. Thereby, the biasing force of the second spring 83 does not work on the pressurizing member 70 to reduce the nip pressure from the pressure P2 to the pressure P1.

Thus, when the nip pressure is reduced from the pressure P2 to the pressure P1, a nip width becomes narrow. Therefore, if the conveyance of the sheet to the fixing nip 78 is carried out by the same speed as the conveyance speed determined for the nip pressure P2, there is fear of insufficiently fixing the toner image on the sheet. Then, in such a case, the conveyance of the sheet to the fixing nip 78 is controlled at a lower speed than the normal speed by the controller 84. Thus, the controller 84 reduces the conveyance speed of the sheet to the fixing nip 78 in a case where the pressure of the fixing nip 78 is the pressure P1 in comparison with another case where the pressure of the fixing nip 78 is the pressure P2. Thereby, it is possible to lengthen passing time of the sheet through the fixing nip 78 and to securely fix the toner image on the sheet.

In addition, as mentioned above, when the nip pressure changing mechanism 37 turns 180 degrees, as shown in FIG. 11, the sensed object 53 attached on the sensing lever 52 of the nip pressure changing mechanism 37 is detached from a space between the light emitting part 44 and light receiving part 45 of the sensing mechanism 43 of the printer main body 2. Accordingly, the sensing mechanism 43 senses the turn of the nip pressure changing mechanism 37, and then, outputs the sensing signal to the controller 84.

In the first embodiment, the nip pressure changing mechanism 37 is attached to the printer main body 2 instead of the fixing unit 18. It is therefore possible to simplify the configuration of the fixing unit 18 so as to decrease the number of components and manufacturing costs and to miniaturize the fixing unit 18. In addition, because the printer main body 2 is provided with the nip pressure changing mechanism 37, the printer main body 2 can bear great load caused in changing the nip pressure. It is therefore possible to prevent excessive load from being applied to the fixing unit 18 and to increase stability in changing the nip pressure.

In addition, by arranging the nip pressure changing mechanism 37 outside the fixing unit 18, because room for layout is caused in the fixing unit 18, distances from the engaging part 74 to the first spring reception 76 and second spring reception 80 are lengthened by the room, thereby increasing leverage. Accordingly, spring pressures of the first spring 77 and second spring 83 can be decreased.

Moreover, a distance between the heating roller 58 and pressing roller 60 is restricted by a spring pressure of the first spring 77 and second spring 83. Therefore, in comparison with a case of applying single spring, it is possible to flexibly vary the distance between the heating roller 58 and pressing roller 60.

Furthermore, the second spring reception 80 is located at a position further away from the engaging part 74 than the first spring reception 76. Therefore, in comparison with a case of locating second spring reception 80 at another position closer to the engaging part 74 than the first spring reception 76, it is possible to lengthen a distance from the second spring reception 80 to the engaging part 74. Accordingly, a spring pressure of the second spring 83 can be more decreased.

In addition, in the first embodiment, by operating the operation/display unit 86, a change of the nip pressure can be automatically carried out. Therefore, in comparison with a case of manually changing the nip pressure, it is possible to reduce a load on the worker, such as a user or a serviceman.

Moreover, the shaft hole 38 is arranged between the upper side conveying frame 35 and lower side conveying frame 36. Therefore, because the upper side conveying frame 35 and lower side conveying frame 36 supports the shaft 50 in a sandwiching state, it is possible to prevent a deflection of the shaft 50.

Although the first embodiment applies the shaft 50 made of metal, another embodiment may be configured to apply another shaft 50 made of resin. The quality of the material of a shaft 50 may be selected for each type of the machine, for instance, a high-end type of a machine (a high speed machine) with a great load on the shaft 50 is provided with a metal shaft, while a low-end type of another machine (a low speed machine) with a lower load on the shaft 50 than the high-end type is provided with another resinous shaft. In the first embodiment, because the shaft 50 is attached to the printer main body 2 instead of the fixing unit 18, even if the quality of the material of a shaft 50 is selected for each type of the machine, the common fixing unit 18 can be applied to the different types of the machines.

The first embodiment was described about a configuration of pivotally supporting the right end of the shaft 50 by the right guide cassette 32 arranged on the right main body frame 24 of the printer main body 2 and pivotally supporting the left end of the shaft 50 by the upper side conveying frame 35 of the conveying unit 26. On the other hand, a further embodiment may apply another configuration of pivotally supporting both ends of the shaft 50 by the left and right main body frame 23 and 24 of the printer main body 2 or by the conveying unit 26.

The first embodiment applies the fixing nip forming mechanism 61, so-called "a spring pressure restricting type", using the first spring 77 and second spring 83. On the other hand, a furthermore embodiment may be configured to apply another fixing nip forming mechanism 61, so-called "a shaft center distance adjusting type", configured to adjust a shaft center distance between the first rotating member and second rotating member.

Although, the nip pressure in the first embodiment is changed between the pressures P1 and P2, another embodiment may be configured to change the nip pressure among three or more pressures.

The first embodiment was described in case of applying the heating roller 58 for the first rotating member and applying the pressing roller 60 for the second rotating member. On the other hand, in a further embodiment, the first or second rotating member may be configured by using a belt.

Although the first embodiment was described in case of applying the heater for a heating source, a furthermore embodiment may apply another heating source, such as an IH coil or the like.

The first embodiment was described in a case where ideas of the disclosure are applied to the printer. On the other hand, in another embodiment, the ideas of the disclosure may be applied to another image forming apparatus, such as a copying machine, a facsimile or a multifunction machine.

Second Embodiment

Figure 12:
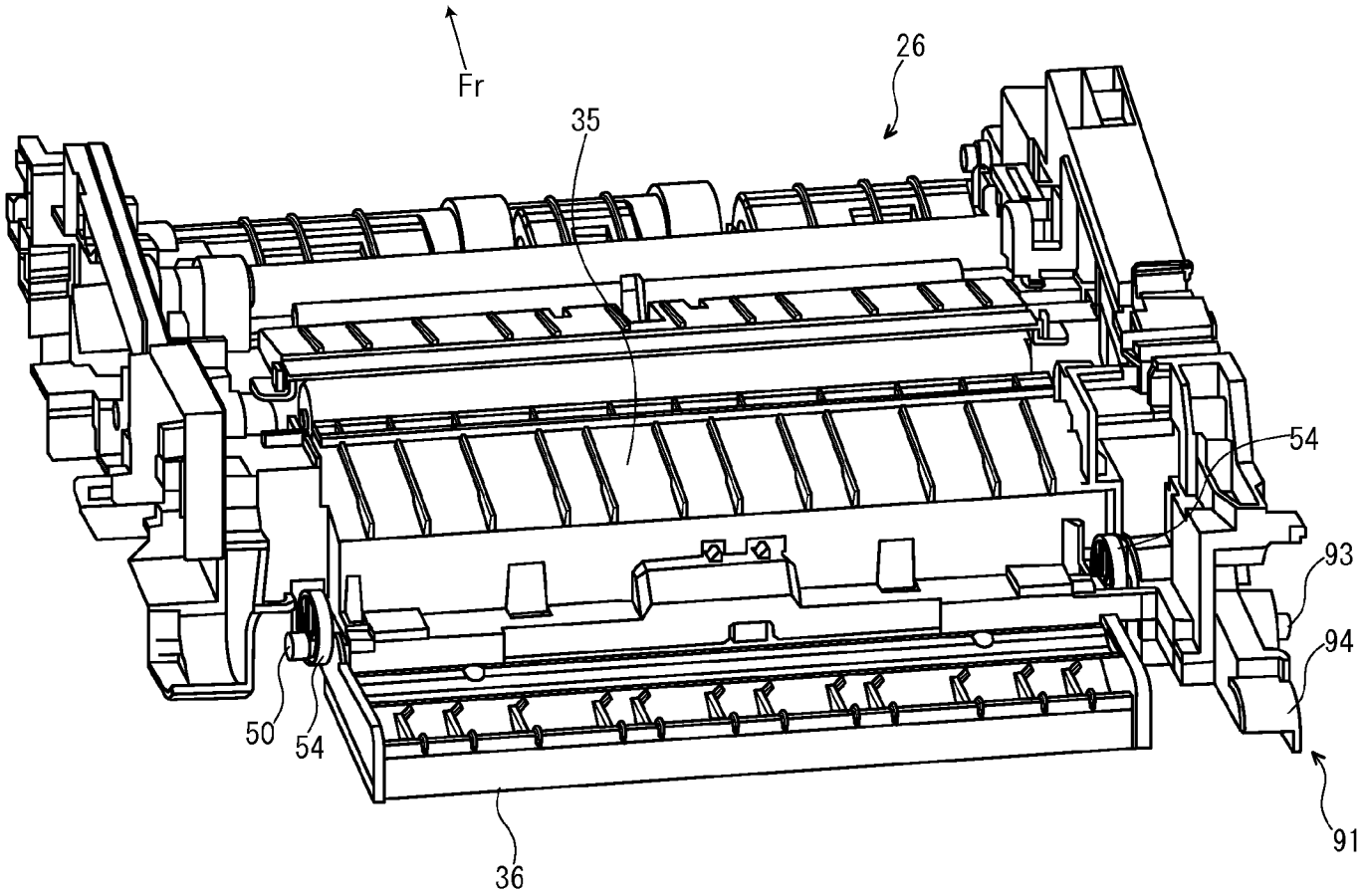
FIG. 12 is a back perspective view showing a conveying unit in a printer according to a second embodiment of the present disclosure.
Figure 13:
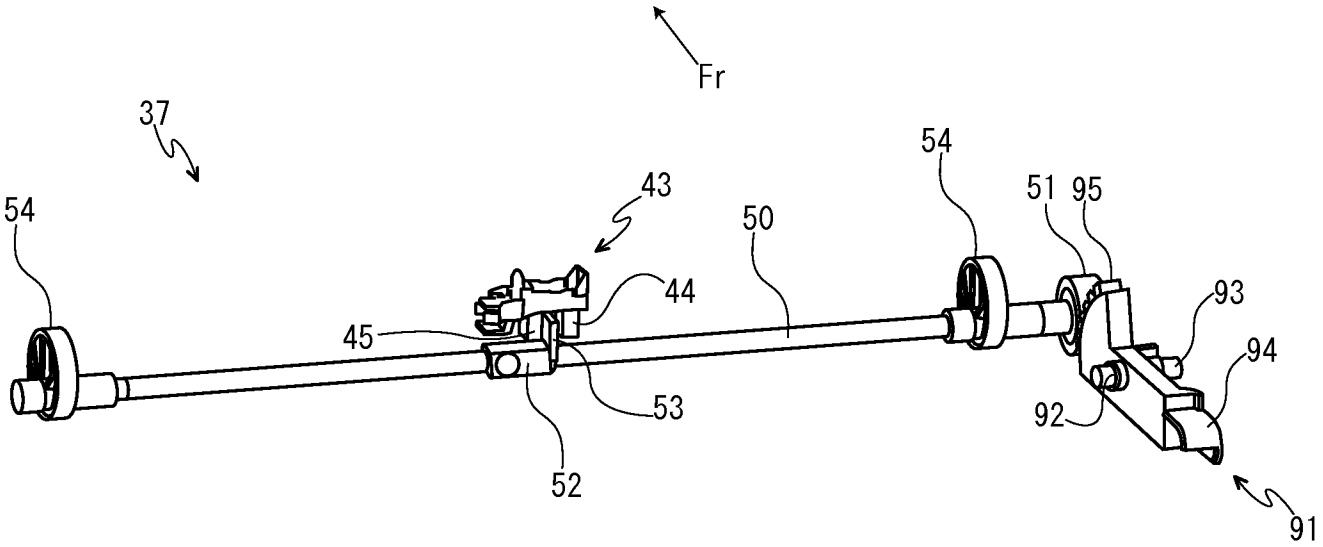
FIG. 13 is a back perspective view showing a connecting gear and a nip pressure changing mechanism in the printer according to the second embodiment of the present disclosure.

Now, a second embodiment will be described with reference to FIGS. 12 and 13. FIG. 12 is a back perspective view showing a conveying unit in a printer according to the second embodiment of the present disclosure. FIG. 13 is a back perspective view showing a connecting gear and a nip pressure changing mechanism in the printer according to the second embodiment of the present disclosure. A repetitive description will be omitted for some of the constituent elements that correspond to those of the first embodiment.

As shown in FIG. 12, at a left end side of the conveying unit 26, an operating lever 91 is attached backward. As shown in FIG. 13, in a front part of the operating lever 91, a rod hole 92 is bored in the left and right directions and the rod hole 92 is penetrated by a rotating rod 93 fixedly attached to the printer main body 2. Thereby, the operating lever 91 is rotatably supported by the printer main body 2. In a rear end of the operating lever 91, a gripper 94 is formed and, in a front end of the operating lever 91, a fan-formed transmitting gear 95 is formed. The transmitting gear 95 is connected with the driving gear 51 attached to the nip pressure changing mechanism 37.

In such a configuration, when the worker, such as a user or a serviceman, operates the gripper 94 of the operating lever 91 upward or downward, the operating lever 91 turns around the rotating rod 93. This turn is transmitted to the shaft 50 via the transmitting gear 95 and driving gear 51, thereby turning the nip pressure changing mechanism 37. According to this, the cam 54 turns so that a pressing state and a release state of the cam 54 to the spring holder 71 (not shown in FIG. 13) are switched, and then, the same effect as the first embodiment is caused to change the nip pressure. Thus, in the second embodiment, it is possible to manually change the nip pressure by a simpler configuration than an automatic nip pressure change.

As mentioned above, the first embodiment makes the nip pressure changing mechanism 37 automatically turned, while the second embodiment makes the nip pressure changing mechanism 37 manually turned. Therefore, the first embodiment and second embodiment are different from each other in apart of structure of the printer main body 2. On the other hand, structure of the fixing unit 18 is common to the first embodiment and second embodiment. Thus, because the nip pressure changing mechanism 37 can be arranged to the printer main body 2, it is possible to switch a turning manner of the nip pressure changing mechanism 37 between the automatic or manual manners in accordance with a purpose of each user and usage environment and to communize the fixing unit 18. Thereby, it is possible to make the fixing unit 18 in one style corresponded with various types of machines, such as the high-end machine or low-end machine and to facilitate compliance with various demands on the market in development phase.

In comparison between a case (refer to the first embodiment) of making the nip pressure changing mechanism 37 automatically turned and another case (refer to the second embodiment) of making the nip pressure changing mechanism 37 manually turned, a difference between both is a member arranged to a part of the printer main body 2. That is, by changing the part of the printer main body 2, it is possible to manufacture both a machine of making the nip pressure changing mechanism 37 automatically turned and another machine of making the nip pressure changing mechanism 37 manually turned, and therefore, to keep an increase of manufacturing costs for complying with various manners to a minimum.

Moreover, even if the printer main body 2 in an initial state is not provided with the connecting gear 28 (refer to the first embodiment) and operating lever 91 (refer to the second embodiment) and the nip pressure is limited to one determined value, it is possible to optionally attach the operating lever 91 to the shaft 50, thereby changing the nip pressure.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

a fixing unit; and an apparatus main body to which the fixing unit is attachably/detachably installed, wherein the fixing unit includes, a first rotating member heated by a heating source, a second rotating member facing to the first rotating member, and a fixing nip forming mechanism configured to make the second rotating member pressed to the first rotating member and to form a fixing nip between the first rotating member and second rotating member, the apparatus main body includes a nip pressure changing mechanism, and the nip pressure changing mechanism is configured to press the fixing nip forming mechanism and to change a pressure of the fixing nip, wherein the fixing unit further includes a fixing frame in which the first rotating member and second rotating member are housed, the fixing nip forming mechanism includes a pressurizing member including an engaging part configured to engage with the fixing frame, a holding part configured to hold the second rotating member, and a first spring reception and a second spring reception located on the opposite side of the engaging part across the holding part, a first spring installed between the first spring reception and fixing frame, a spring holder configured to be movable forward and backward in the directions approaching to and going away from the second spring reception, and a second spring installed between the second spring reception and spring holder, and when the nip pressure changing mechanism presses the spring holder, the spring holder moves in the direction approaching to the second spring reception, the spring holder presses the second spring reception via the second spring, and the pressurizing member turns around a side of the engaging part.

2. The image forming apparatus according to claim 1, wherein the second spring reception is located at a position further away from the engaging part than the first spring reception.

3. The image forming apparatus according to claim 1, wherein the fixing frame includes a holder housing and, in an end of the holder housing, an inserting hole is bored, and the spring holder is housed in the holder housing and inserted into the inserting hole.

4. The image forming apparatus according to claim 1, wherein the first spring and second spring are configured by respective coil springs.

5. The image forming apparatus according to claim 1, wherein the nip pressure changing mechanism includes a rotatable shaft, a cam fixedly attached to the shaft to press the fixing nip forming mechanism in accordance with a rotation of the shaft, and a driving gear fixedly attached to the shaft and connected with a driving source.

6. The image forming apparatus according to claim 1, wherein the nip pressure changing mechanism includes a rotatable shaft, a cam fixedly attached to the shaft to press the fixing nip forming mechanism in accordance with a rotation of the shaft, and a driving gear fixedly attached to the shaft and connected with a manual operating lever.

7. The image forming apparatus according to claim 1 further comprising:

a sensing mechanism configured to sense turn of the nip pressure changing mechanism.

8. The image forming apparatus according to claim 7, wherein the sensing mechanism is a photo interrupter sensor including a light emitting part and a light receiving part.

9. The image forming apparatus according to claim 1 further comprising:

a controller configured to control a conveyance speed of a sheet to the fixing nip, wherein the nip pressure changing mechanism is configured to change the pressure of the fixing nip between a first nip pressure and a second nip pressure being greater than the first nip pressure, and the controller is configured to reduces the conveyance speed of the sheet to the fixing nip in a case where the pressure of the fixing nip is the first nip pressure in comparison with another case where the pressure of the fixing nip is the second nip pressure.

10. An image forming apparatus comprising:

a fixing unit; and an apparatus main body to which the fixing unit is attachably/detachably installed, wherein the fixing unit includes a first rotating member heated by a heating source, a second rotating member facing to the first rotating member, and a fixing nip forming mechanism configured to make the second rotating member pressed to the first rotating member and to form a fixing nip between the first rotating member and second rotating member, the apparatus main body includes a nip pressure changing mechanism, and the nip pressure changing mechanism is configured to press the fixing nip forming mechanism and to change a pressure of the fixing nip, the nip pressure changing mechanism includes a rotatable shaft, a cam fixedly attached to the shaft to press the fixing nip forming mechanism in accordance with a rotation of the shaft, and a driving gear fixedly attached to the shaft and connected with a driving source, wherein the apparatus main body further includes a pair of main body frames extending in the upper and lower directions, and a conveying unit bridged between the main body frames, and the conveying unit includes an upper side conveying frame and a lower side conveying frame connected with each other and, between the upper side conveying frame and lower side conveying frame, a shaft hole is formed to permit insertion of the shaft.

11. The image forming apparatus according to claim 10, wherein the upper side conveying frame includes an upper side rib, the lower side conveying frame includes an lower side rib, and the shaft is attached so as to be interposed between the upper side rib and lower side rib.

* * * * *